United States Patent [19]

Pfalzer et al.

[11] Patent Number: 4,773,989

[45] Date of Patent: Sep. 27, 1988

[54] PROCESS FOR THE PREPARATION OF FIBROUS SUSPENSIONS IN HYDROCYCLONES

[75] Inventors: Lothar Pfalzer; Theodor Bahr, both of Heidenheim, Fed. Rep. of Germany

[73] Assignee: J M. Voith, GmbH, Heidenheim, Fed. Rep. of Germany

[21] Appl. No.: 936,465

[22] Filed: Nov. 25, 1986

[30] Foreign Application Priority Data

Dec. 6, 1985 [DE] Fed. Rep. of Germany ..... 3543205

[51] Int. Cl.[4] ..... B03B 5/34

[52] U.S. Cl. ..... 209/12; 209/211; 210/512.2

[58] Field of Search ..... 209/12, 18, 20, 211, 209/144, 17; 210/512.2

[56] References Cited

U.S. PATENT DOCUMENTS

| | | | |
|---|---|---|---|
| 2,379,411 | 7/1945 | Bergès | 209/211 |
| 3,928,186 | 12/1975 | Zemanek | 209/211 |
| 4,167,249 | 9/1979 | Kohrs | 241/46.17 |
| 4,167,438 | 9/1979 | Holz | 209/211 |
| 4,216,918 | 8/1980 | Kahmann et al. | 241/46 B |
| 4,219,381 | 8/1980 | Schnell | 162/9 |
| 4,252,640 | 2/1981 | Musselmann | 209/17 |
| 4,283,232 | 8/1981 | Best | 209/211 |
| 4,283,275 | 8/1981 | Heinbockel et al. | 209/3 |
| 4,292,122 | 9/1981 | Karnis et al. | 209/17 |
| 4,339,042 | 7/1982 | Windle et al. | 209/12 |

FOREIGN PATENT DOCUMENTS

| | | | |
|---|---|---|---|
| 854873 | 9/1952 | Fed. Rep. of Germany | 209/211 |
| 74447 | 11/1953 | Netherlands | 209/211 |
| 2128498A | 5/1984 | United Kingdom . | |

OTHER PUBLICATIONS

"The Hydrocyclone" by D. Bradley, p. 215, FIG. 96, 1965.

"Auslegung von Zyklonabscheidern zur Trennung der Fasersysteme", Haus der Technik e.V., May 5, 1983, p. 46.

*Primary Examiner*—Robert B. Reeves
*Assistant Examiner*—Donald T. Hajec
*Attorney, Agent, or Firm*—Albert L. Jeffers

[57] ABSTRACT

The process for cleaning fibrous suspension in a multi-stage cleaner plant, in which one part is led off from the first stage as accept and the remaining part of the first stage is further prepared in subsequent stages. The cleaners (1) of the first stage (S1) serve to prepare three fractions including the accept fraction, and an accept content of at most between 35% and 45% is removed from these cleaners. In this way, the number of cleaners. In this way, the number of cleaners in the process can be reduced.

5 Claims, 1 Drawing Sheet

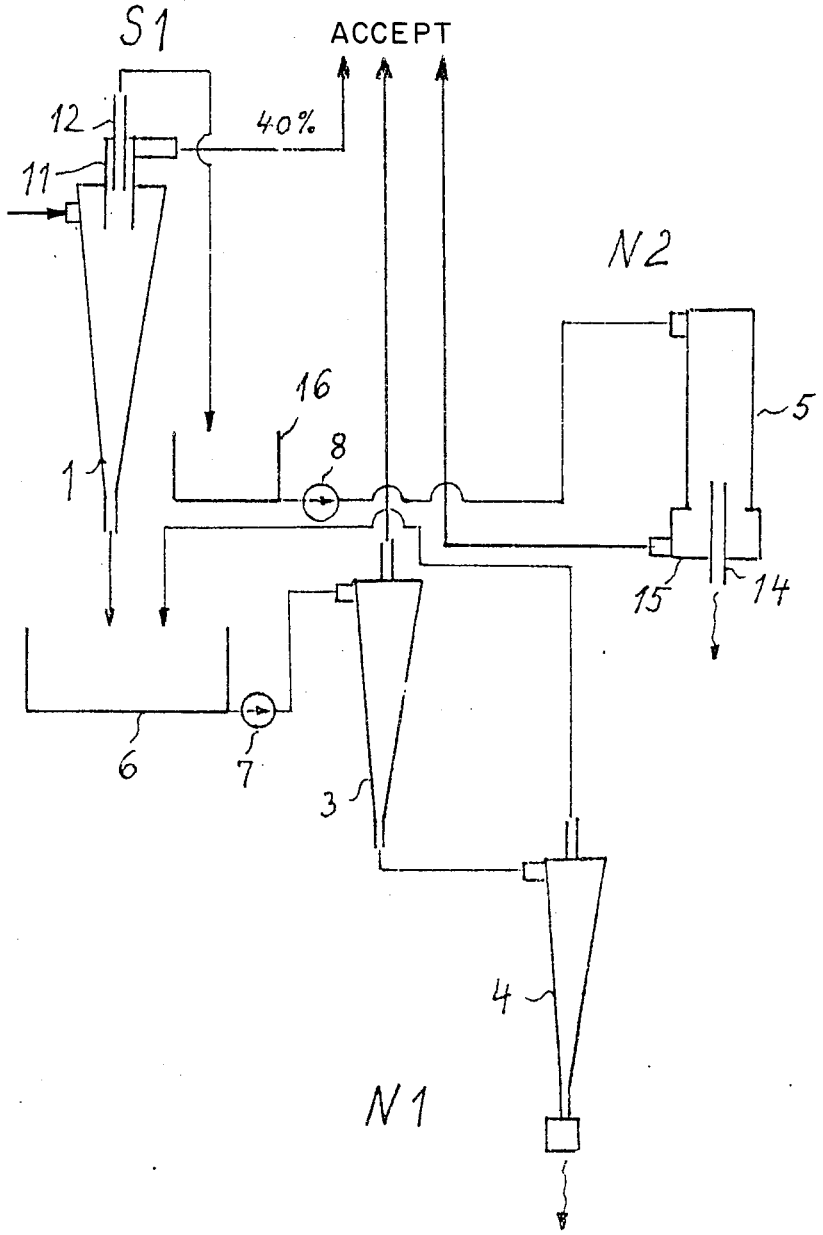
S1
ACCEPT
12
40%
11
N2
16
5
8
1
15
14
6
7
3
4
N1

PROCESS FOR THE PREPARATION OF FIBROUS SUSPENSIONS IN HYDROCYCLONES

BACKGROUND OF THE INVENTION

This invention relates to a process for cleaning fibrous suspensions in a multi-stage cleaner plant. More specifically the invention relates to such a process in which one fraction is removed as accept from the first cleaner stage and wherein the remaining fractions of the first cleaner stage are processed further in subsequent stages. A prior art apparatus for carrying out such a process is disclosed in the book by Bradley entitled "The Hydrocyclone", on Page 215, FIG. 96 thereof.

In many modern plants using a plurality of hydrocyclones, conventionally called cleaners, for preparing fibrous suspensions, the accept fraction is conveyed from the first cleaner stage out of the cleaner plant. Normally, however, at least one fraction from a later stage is returned to the first stage. The subsequent stages are generally joined in cascade. Consequently, there is a cascade connection inside such cleaner plants from the first stage to the last stage. Due to the total number of cleaners required, such prior art cleaner plants occupy a large amount of space yet, in spite of this, effectiveness of such plants in separating soil is not completely satisfactory.

SUMMARY OF THE INVENTION

The present invention overcomes the disadvantages of the above described prior art cleaning processes by providing an improved process therefor.

The object of the invention is to provide an effective process for cleaning fibrous suspensions in cleaner plants i.e. a process by which good soil separation is achieved, and which reduces the number of cleaners required.

The process according to the invention comprises supplying three cleaning stages. In a first stage, one fraction from a first cleaner is delivered as accept. The lightweight fraction of the first cleaner stage is treated further in a unidirectional cleaner from which the heavyweight separated fraction is delivered as accept. The heavyweight fraction from the first stage is delivered to a third stage wherein it is separated in plurality of cleaners which are cascade connected. The lightweight fractions from these cascade connected cleaners is delivered as accept.

BRIEF DESCRIPTION OF THE DRAWING

The Figure discloses a schematic arrangement of the apparatus for practicing the invention.

The exemplification set out herein illustrates a preferred embodiment of the invention, in one form thereof, and such exemplification is not to be construed as limiting the scope of the disclosure or the scope of the invention in any manner.

DESCRIPTION OF THE PREFERRED EMBODIMENT

Referring to the drawing, the process is shown with the cleaners arranged in accordance with the invention. The cleaners of the first stage S1 are designated by 1, the cleaners of the following stages of auxiliary circuits N1 and N2 are designated by 3, 4 or 5 respectively. The cleaners 1 of the first stage S1 are of a design in which three fractions are prepared including the accept fraction, and wherein the lightweight soil fraction is removed through a central upper pipe 12. The accept fraction is removed through an extraction pipe 11 positioned concentrically with and around pipe 12. The heavy soil, i.e. the heavyweight fraction to which heavy soil is attached, is extracted in a well known way in the lower part of the conical cleaner body and is delivered into a collection vat 6. The accept fraction of the first stage is conveyed out of the cleaner plant, since it is relatively clean. For this purpose an accept content of 30% to 50% of the amount supplied to the first stage is extracted from the cleaners 1 and typically a maximum content of 40% is removed from the first stage. The lightweight soil fraction, which is approximately 30% of the amount supplied to the first cleaner stage is delivered to a collection vat 16, from which it is supplied by means of a pump 8 to the second stage circuit N2 and consequently to the unidirectional cleaners 5 situated therein. Cleaner 5 includes a substantially upright cleaner body to the top of which the suspension is supplied, while at the bottom of the cleaner body a lightweight soil fraction is removed through a central pipe 14 and the heavyweight fraction is removed from a circular area surrounding this pipe.

In this case, the heavyweight fraction is the accept, as the suspension supplied as lightweight fraction does not substantially contain any heavy soil. Cleaners of this design are described in the technical paper "Auslegung von Zyklonabscheidern zur Trennung der Fasersysteme" (Exposition of cyclone separators for the separation of fibrous systems), Page 46, with special reference to FIG. 40 on the left, in Haus der Technik e.V. dated May 5th, 1983. This cleaner design is called unidirectional because essentially there is no reversal of flow from the inlet to the exit.

The heavyweight fraction of the first stage S1 is supplied from the collection vat 6 by means of pump 7 to the second auxiliary circuit N1, which consists of cleaners 3 and 4 for preparing two fractions, but which are not of a unidirectional design. With these cleaners, there is the conventional reversal of flow of the lighter components. The heavy components, which generally include heavy soil, are removed at the apex of the cone located at the bottom of the cleaner. These cleaners 3 and 4 are connected in cascade, as can be seen from the drawing. The accept fraction is then removed from the first cleaner 3 of this cascade arrangement and out of the cleaner plant. The heavyweight soil of the cleaner is discarded after leaving the cleaner 4.

Likewise, the lightweight soil which leaves cleaner 5 of auxiliary circuit N2 at the bottom thereof and is generally discarded. This fraction may also be reclaimed with a special apparatus, i.e. in screening devices having a rotationally symmetrical wire basket, and sorting vanes for brushing against the perforations thereof.

The advantage of the plant lies in the fact that the extracted accept is relatively clean, and that, by using relatively large cleaners 1 in the first stage S1, but a correspondingly small total number of cleaners the number of which is a fraction of the throughput, a certain amount of space can be saved, i.e. assembly area of the cleaner plant. However, as mentioned, of more significance is the advantage that the accept is of better quality, i.e. that it contains fewer soil particles than was possible with comparable prior art plants.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A process for cleaning fibrous suspension of soil contaminants in a multi-stage cleaner plant, said plant having first, second, and third stages, said third stage comprising a plurality of cascade connected cleaners, said process including the steps of:

preparing three fractions in said first stage including a first accept fraction consisting of at least 30% to at most 50% of the amount supplied to the first stage, a lightweight fraction, and a heavyweight contaminants fraction;

removing said first accept fraction from said first stage through an extraction pipe which is coaxially arranged with a lightweight soil extraction pipe;

delivering the lightweight fraction from said first stage to said second stage and cleaning said lightweight fraction further in a unidirectional cleaner of said second stage;

delivering the heavyweight fraction from said unidirectional cleaner as a second accept fraction;

delivering the heavyweight contaminants fraction from said first stage to said third stage;

preparing at least two fractions in said third stage, including a lightweight fraction; and delivering as a third accept fraction the lightweight fraction from said third stage.

2. A process for cleaning a fibrous suspension containing soil contaminants to prepare an accept which is cleaned of soil, said process comprising the steps of:

(a) providing a first cleaner stage having an input and including at least one cleaner of the type capable of preparing three fractions;

(b) delivering said fibrous suspension to the input of said first cleaner stage and preparing three fractions including a lightweight fraction, a first accept fraction, and a heavyweight contaminants fraction, said first accept fraction consisting of at least 30% to at most 50% of the amount of said fibrous suspension delivered to the input of said first cleaner stage;

(c) providing a second cleaner stage having an input and a cleaner of the type capable of preparing two fractions;

(d) delivering the lightweight fraction of said first cleaner stage to the input of said second cleaner stage and preparing two fractions including a heavy fraction and a light fraction, the heavy fraction thus prepared being a second accept fraction;

(e) providing a third cleaner stage having an input and a plurality of cleaners connected in cascade, said plurality of cleaners connected in cascade being capable of preparing two fractions;

(f) delivering the heavyweight contaminants fraction of the first cleaner stage to the input of said third cleaner stage and preparing two fractions including a heavy fraction and a light fraction, the light fraction thus prepared being a third accept fraction.

3. The process of claim 2, in which the cleaner of said second cleaner stage is a unidirectional cleaner.

4. The process of claim 2, including the step of removing the first accept fraction of the first cleaner stage from a coaxial extraction pipe which is disposed around a central lightweight soil extraction pipe.

5. The process of claim 2, in which the dimensions of the at least one cleaner of the first stage are provided to correspond with the required throughput and produce a very clean accept fraction.

* * * * *